United States Patent [19]

Baum

[11] 4,193,488

[45] Mar. 18, 1980

[54] COIN-OPERATED WASHING MACHINE CYCLE TIME REDUCER

[75] Inventor: John W. Baum, Fisherville, Ky.

[73] Assignee: General Electric Company, Louisville, Ky.

[21] Appl. No.: 913,922

[22] Filed: Jun. 8, 1978

[51] Int. Cl.[2] ..... G07F 5/10

[52] U.S. Cl. ..... 194/9 T; 194/DIG. 18

[58] Field of Search ..... 194/DIG. 18, 9 T, 1 E; 74/568 T, 568 R, 103, 104, 107

[56] References Cited

U.S. PATENT DOCUMENTS

| | | | |
|---|---|---|---|
| 2,947,186 | 8/1960 | Greenwald | 194/DIG. 18 |
| 3,009,390 | 11/1961 | Gale | 88/61 |
| 3,012,428 | 12/1961 | Cissell | 194/DIG. 18 |
| 3,046,803 | 7/1962 | Bowman | 194/1 E |
| 3,237,466 | 3/1966 | Purtilo | 194/9 T |
| 3,990,318 | 11/1976 | Cahoe et al. | 194/92 |

*Primary Examiner*—Allen N. Knowles

*Attorney, Agent, or Firm*—Bruce A. Yungman; Radford M. Reams

[57] ABSTRACT

An arrangement for shortening the cycle time of coin-operated washing machines by modifying a timer setting action produced by reciprocation of a coin-operating mechanism slide. The arrangement includes a shim element assembled to the actuation arm of a clutch mechanism driven by the coin slide assembly to advance the initial setting of a timer controlling the duration of the washing machine cycles. The shim is configured to be snap-fitted to the actuation arm.

2 Claims, 5 Drawing Figures

COIN-OPERATED WASHING MACHINE CYCLE TIME REDUCER

BACKGROUND DISCUSSION

This invention concerns coin-operated machines and more particularly coin-operated clothes washing machines such as are utilized in commerical laundromats.

Typically, such machines include a coin-operating mechanism comprised of a coin slide assembly which is enabled to be reciprocated upon insertion of the proper coinage. The coin slide assembly engages a clutch mechanism which in turn is in driving relationship with the input shaft of a timer mechanism as the coin slide assembly is reciprocated. The timer mechanism includes an input shaft which is rotated by the clutch mechanism to a given set position, at which point the machine operation is initiated and the various agitation, rinse and spin cycles take place.

The efficient use and load turnover of coin-operated equipment is directly effected by the duration of the cycle for carrying out the complete wash, rinse and spin drying of the clothes. That is, increased use of the equipment can be realized if the cycle time is reduced.

At the same time, the cycle duration for the given washing machine design is established by the basic design of the controls of a given machine. The duration of each of the cycles is established for maximum effectiveness insofar as the washing and rinsing action are concerned. Generally in establishing the duration of the agitation cycle, the designers establish an agitation time based on an evaluation of the needs of potential users of the particular model machine and effect a design compromise as to duration of the agitation cycle.

For commercial washers, the agitation cycle is somewhat shorter than machines intended for home use.

The washing action achieved during the course of the agitation cycle exhibits a characteristic rapid decrease in washing action effectiveness as the agitation cycle proceeds. That is, the last minute or two contribute relatively little to the machine effectiveness in washing of the clothes.

Accordingly, for a given laundromat operation, the proprietors may conceivably wish to further shorten the duration of the agitation cycle to thereby increase the return on their investment without significantly adversely affecting customer relations.

As noted, however, the cycle duration for a given model of the coin-operated machines has been basically established with no easily implemented method provided, short of field reworking of the control mechanism, to adjust the agitation cycle duration. Such field modification would normally be prohibitively expensive and generally preclude such adjustment to cycle time duration.

Accordingly, it is the object of the present invention to provide an arrangement and method for modifying the agitation cycle time duration of such coin-operated washing machines in the field by a relatively simple and readily carried out modification of the machine.

SUMMARY OF THE INVENTION

This and other objects of the present invention, which will become apparent upon a reading of the following specification and claims, are achieved by the use of a cycle time reducer shim block which is readily assembled into the coin-operating mechanism which has the effect of rotating the timer shaft to a rotative position advanced from that normally set by reciprocation of the coin slide assembly. The advancing of the shaft set position has the effect of shortening the machine agitation cycle time by a predetermined interval selected to be of sufficiently short duration as to not significantly affect the washing cycle.

The cycle time reducer shim block is designed to be snap assembled to a clutch actuating arm such as to be secure when engaged by a coin slide assembly, without necessitating the use of tools or fasteners.

DETAILED DESCRIPTION

In the following detailed description, certain specific terminology will be utilized for the sake of clarity and a particular embodiment described in accordance with the requirements of 35 USC 112, but it is to be understood that the same is not intended to be limiting and should not be so construed inasmuch as the invention is capable of taking many forms and variations within the scope of the appended claims.

Figure 1:
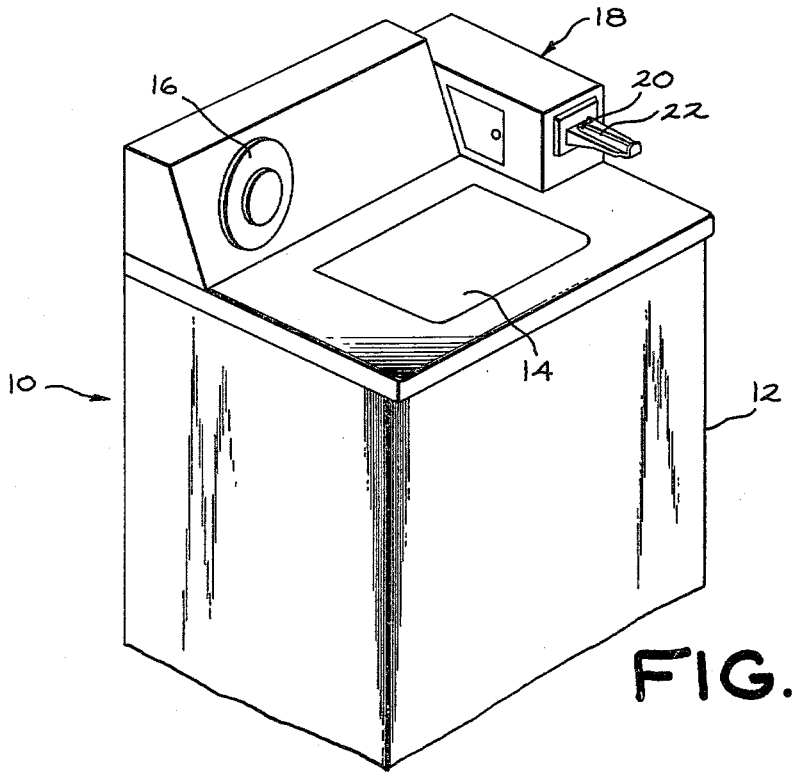
FIG. 1 is a perspective view of the exterior of a coin-operated washing machine of the type to which the present invention is applicable.

Referring to the drawings and particularly FIG. 1, the clothes washing machine 10 includes the conventional outer cabinetry 12 with an access door 14 which enables clothes to be added to the clothes receiving basket and appropriate controls 16 allowing selection of the desired cycle in accordance with the fabric type to be washed.

Also included is a coin-operating mechanism 18.

This includes a coin-receiving mechanism 20 which allows the particular coin denomination to be inserted to initiate the machine operation. The coin-receiving mechanism 20 includes a conventional coin slide assembly 22.

Figure 2:
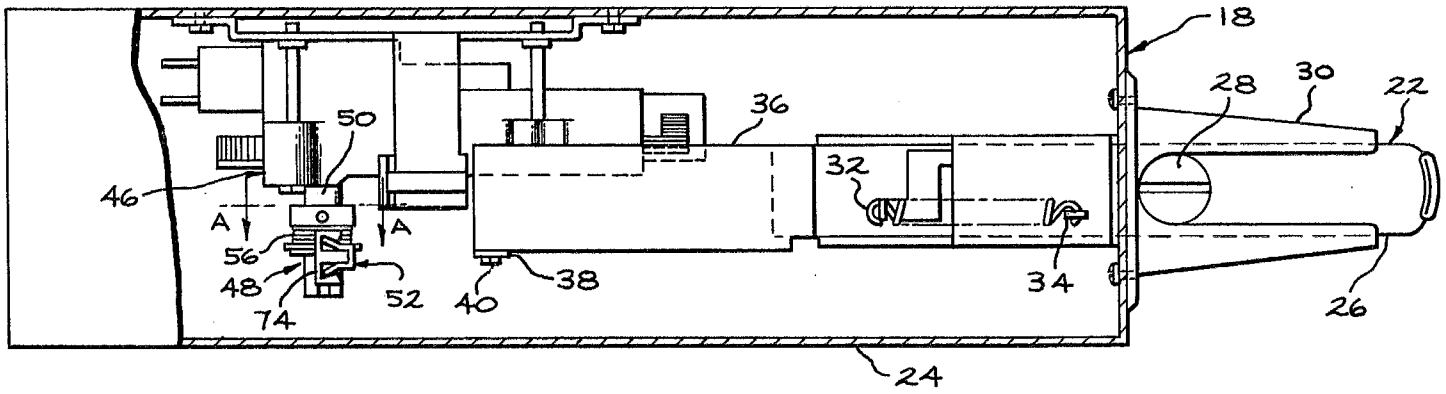
FIG. 2 is an elevational view of the coin-operating mechanism incorporated in the washing machine depicted in FIG. 1, with the exterior cover partially broken away to reveal the details of the coin-operating mechanism components.

As seen in FIG. 2, the coin operating mechanism 18 includes an outer housing comprised of a sheet metal cover 24 enclosing the various components of the coin operating mechanism 18.

The coin slide assembly 22 includes an outer coin slide 26 being formed with an opening 28 adapted to receive the particular coin denomination which the mechanism is adapted to receive. The outer coin slide 26 is received within a slide housing 30 secured to the cover 24.

The outer coin slide 26 extends into the interior of the cover 24 and is provided with a return spring 32 anchored at one end to the coin slide assembly 22 and affixed at the other end to a stationary anchor point 34. Thus, as the outer coin slide 26 is forced inwardly, the return spring 32 is placed in tension such as to create a return bias on the coin slide assembly 22.

The coin slide assembly 22 also includes a slide extension 36 affixed to the outer coin slide 26 at the inside end thereof.

It should be understood that there is included in the coin-operating mechanism 18 the conventional components preventing reciprocation of the coin slide assembly 22, except upon deposit of the proper coinage into the opening 28. This mechanism is not disclosed inasmuch as it is of conventional design and does not comprise part of the present invention.

The slide extension 36 is reciprocated together with the outer coin slide 26. The slide extension 36 carries at its outer end an actuation element 38 extending downwardly from the far end of the slide extension 36 at right angles thereof being affixed by means of fasteners 40 and key 42 such as to be rigidly secured. The outer end of the actuation element 38 is provided with a camming element 44 which is provided by a molded plastic cap secured thereto.

The reciprocation of the coin slide assembly 22 is designed to set into operation a timer mechanism 46. The timer mechanism 46 in turn is interconnected with the machine controls to enable the various machine cycles to be executed, i.e., the agitation, spin and rinse cycles for a set period of time controlled by the timer mechanism 46.

The timer mechanism 46 is in turn set by means of a timer clutch assembly 48 which causes a timer input shaft 50 to be rotated to a preset initial position by reciprocation of the coin slide assembly 22.

The reciprocation of the coin slide assembly 22 is caused to interact with the timer clutch assembly 48 by means of a clutch actuation arm assembly 52 having an upper portion 54 positioned in alignment with the camming element 44 so as to be engaged therewith upon reciprocation of the coin slide assembly 22.

Figure 3:
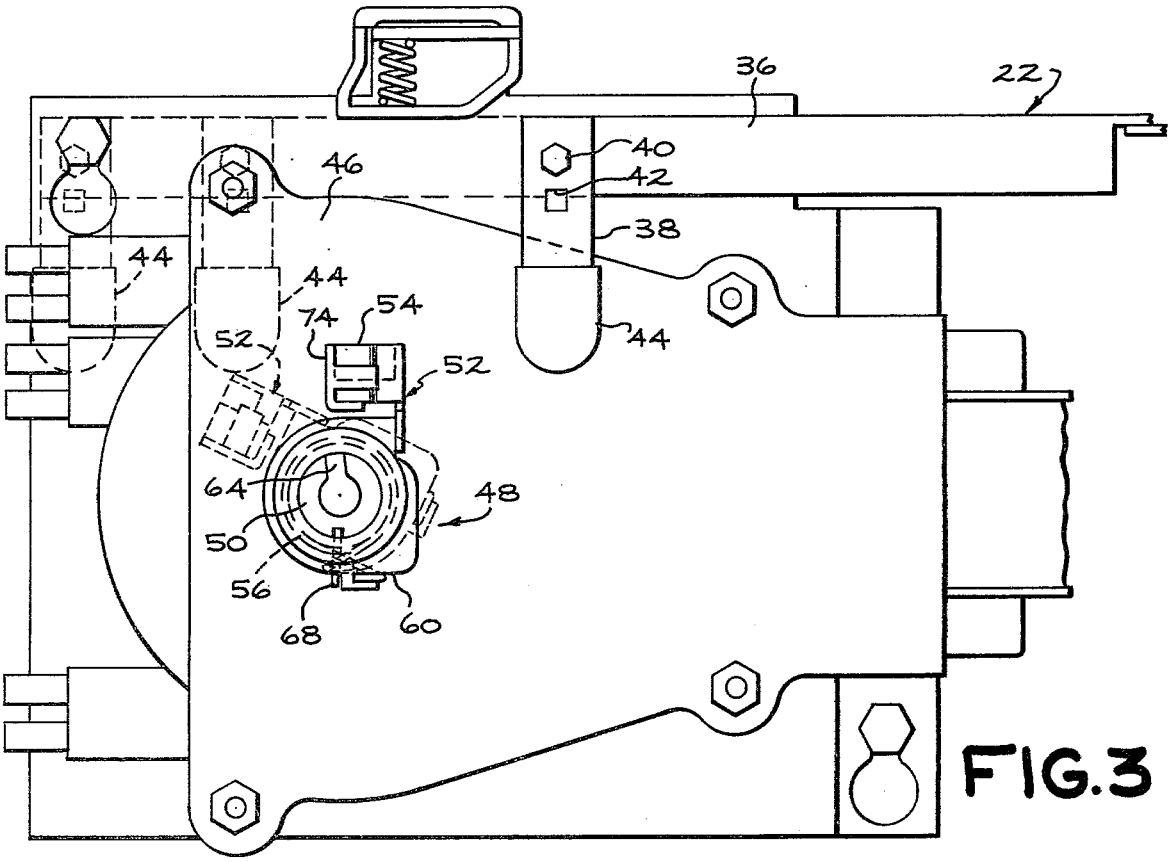
FIG. 3 is a side elevational view of a portion of the coin-operating mechanism depicted in FIG. 2, along the direction of the arrows A—A, depicting the movement of components during inward stroke of the coin-operating mechanism slide assembly.
Figure 5:
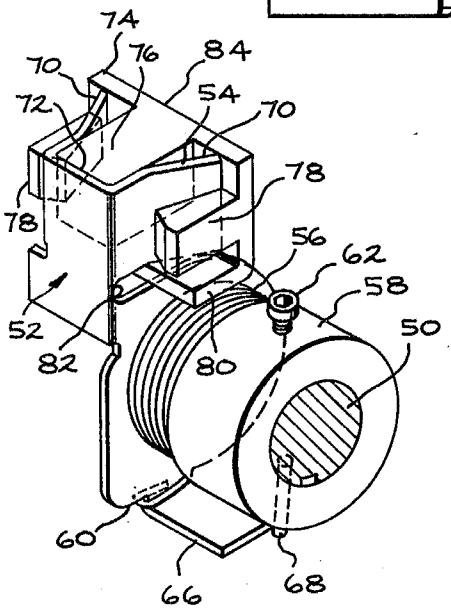
FIG. 5 is a perspective view of the clutch collar and actuation arm assembly with the cycle time reducer installed on the timer clutch actuation arm.

In the inward reciprocating movement as depicted in FIG. 3, the clutch actuation arm 52 slips with respect to the timer input shaft 50 such that the clutch actuation arm 52 is moved out of the way of the upper portion 54 as the coin slide assembly 22 advances to the inmost position. This slippage is achieved by the use of a torsional spring 56 encircling a clutch collar 58 included in the timer clutch assembly 48. The torsional spring 56 has one end anchored to a lower portion 60 as best seen in FIG. 5, with the other end anchored to the clutch collar 58 such as to provide a resilient spring connection between the clutch actuation arm 52 and the clutch collar 58.

The clutch collar 58 is in turn secured to the timer input shaft 50 by means of a set screw 62 and a roll pin 68 extending into the keyway 64.

Figure 4:
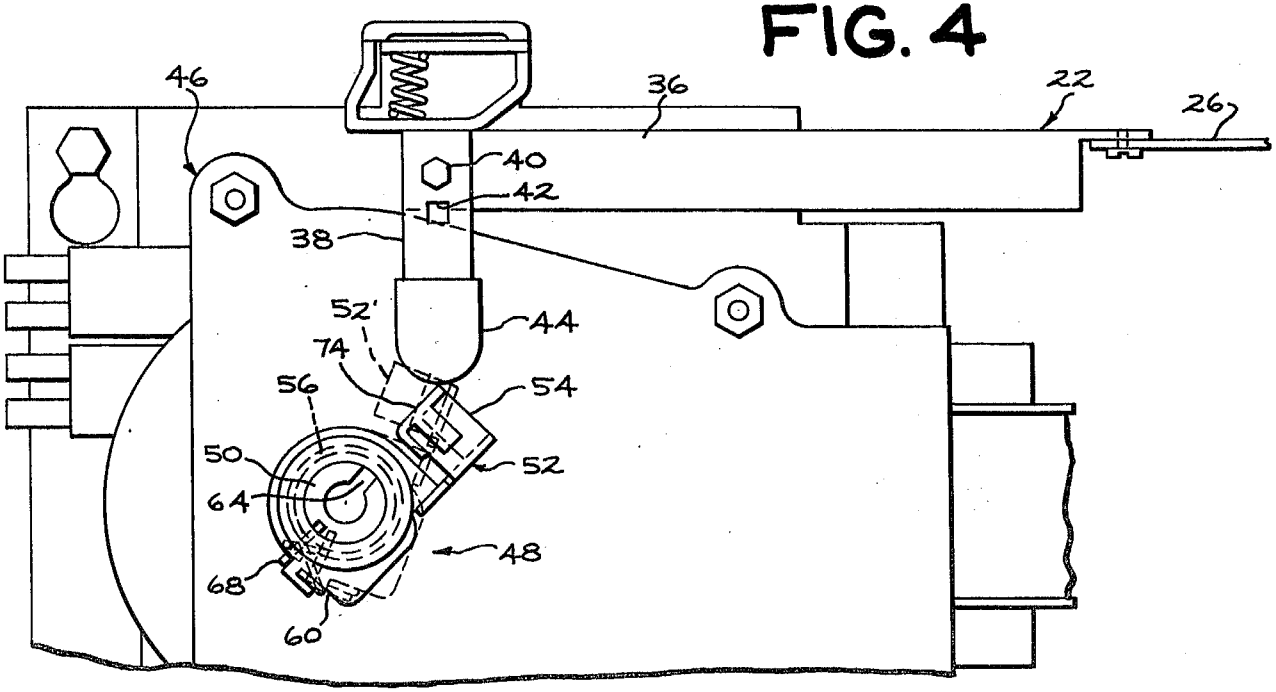
FIG. 4 is a side elevational view of the coin-operating mechanism along the direction of arrows A—A in FIG. 2, depicting the movement of components during the outward stroke of the coin-operating mechanism slide assembly and depictng the differing relationship of the timer clutch actuation arm, both with and without the cycle time reducer shim installed.

This resilient connection is in the counterclockwise direction as viewed in FIGS. 3 and 4 and allows relative rotation between the clutch actuation arm 52, the timer input shaft 50 and the clutch collar 58, during the inward sliding movement of the coin slide assembly 22.

This is indicated in FIG. 3 in which the clutch actuation arm 52 moves away upon engagement of the rear face of the camming element 44 to be rotated counterclockwise, enabling passage of the coin slide assembly 22 to the inmost position shown in FIG. 3.

After the coin slide assembly 22 moves to this inmost position, the clutch actuation arm 52 returns to its original position under the influence of the torsional spring 56.

In the opposite rotative direction, the clutch actuation arm 52 is joined for positive rotation with the clutch collar 58 such that the clutch actuation arm 52 rotates with clutch collar 58, as well as the timer input shaft 50, such that the timer input shaft 50 will be rotated clockwise to the appropriate start position. This connection is via a tab 66 secured to the clutch actuation arm 52 at one end and to a roll pin 68 extending into the clutch collar 58 at the other end.

Thus, upon return movement, as indicated in FIG. 4, the camming element 44 causes the clutch actuation arm 52 to be rotated clockwise which in turn causes the rotation of the timer input shaft 50 in a clockwise direction as viewed in FIG. 4.

The clutch actuation arm 52 is provided with a pair of diverging wing portions 70, which together form a channel 72 which normally receives the camming element 44 during the outward reciprocal movement of the coin slide assembly 22 and is acted on by the camming element 44 in rotating the clutch actuation arm 52.

According to the arrangement of the present invention, a molded plastic cycle time reducer shim block 74 is assembled to the clutch actuation arm 52 by a snap fitting frictional engagement with the wings 70. The cycle time reducer shim 74 is a generally T-shaped block formed of a suitable molded plastic such as Acetal, with the central leg 76 of the "T" nested within the channel 72.

A pair of latching tabs 78 pass over the outwardly extending wings 70, the plastic material being of such resilience to expand to accommodate the wings 70 and snap over the top, serving to frictionally secure the cycle time reducer shim 74 thereto.

A bottom tab 80 extends into slot 82 formed in the clutch actuation arm 52 to completely stabilize the cycle time reducer shim 74 in position on the clutch actuation arm 52, secured against the dislodging force applied by the camming element 44 during the reciprocation of the coin slide assembly 22.

The net result of the presence of the cycle time reducer shim 74 can be seen in FIG. 4, in that without the shim 74, the clutch actuation arm 52′ is in the rotative position of the clutch actuation arm 52 and the timer input shaft 50 and is not as far advanced as with the cycle time reducer shim 74 in position, as indicated in the position of the clutch actuation arm 52.

The exact degree of the advancement depends on the geometry of the particular components.

The reduction in agitation cycle time is a direct function of the initial position of the timer input shaft 50, since the timer input shaft 50 is rotated further into the cycle time. In the advanced position, the length of the time interval which is required in order for the timer input shaft 50 to be rotated clockwise by the timing mechanism to the end position is thereby reduced proportionately.

A practical reduction in cycle time has been found to be on the order of two minutes.

This is easily achieved by the shim configuration of the sort depicted in the drawings in which the engagement face 84 is offset to a point just beyond the leading edges of the wings 70 from the original unshimmed channel 72 formed on the clutch actuation arm 52.

Accordingly, this arrangement and method provides an easily implemented option for the operator of the particular laundromat to reduce the cycle time of the agitation cycle to thereby increase the number of washing cycles which may be carried out by his machine. While this entails a penalty of a slight decrease in washing effectiveness, the particular business establishment may show increased profitability notwithstanding the decreased washing effectiveness of the machines, depending on the experience of the operator with his particular clientele.

The shims may be easily added by snap-fitting the same to the clutch actuation arm 52 such that little or no expense is involved in carrying out modification. Similarly, the shims can be readily removed if it is so desired.

Accordingly, it can be appreciated that this approach accomplishes the above-recited object of the present invention.

The embodiments of the invention in which an exclusive property or privilege is claimed are defined as follows:

1. In a coin-operated clothes washing machine of the type having a coin-operated mechanism, said coin-operated mechanism including a coin slide assembly adapted to be reciprocated after deposit of the correct coinage for operation of the clothes washing machine and further including a timer mechanism adapted to be set by reciprocation of said coin slide assembly by means including an actuation arm rotated by reciprocation of said coin slide assembly, wherein said actuation arm includes diverging wing portions, in combination:

a cycle time reducer shim mounted to said coin operated mechanism and interengaging with said coin slide assembly and said actuation arm to cause further advancement of the position of said actuation arm upon reciprocation of said coin assembly with said shim in position, and wherein said cycle time reducer shim is formed with engagement tabs snap-fitted over said diverging wing portions of said actuation arm to secure said shim to said actuation arm, whereby said cycle time of said clothes washing machine is shortened by advancement of said timer mechanism.

2. The clothes washing machine according to claim 1 wherein said actuation arm is further formed with a channel section defined in part by said diverging wing portions and wherein said shim is of generally T-shape, said central leg of said T disposed in said channel section in abutment against the bottom thereof, and wherein said channel section is disposed to be engaged by a portion of said coin slide assembly, whereby the presence of said cycle time reducer shim displaces the engagement face of said actuation arm by the presence of said central leg of said T section of said cycle time reducer shim.

* * * * *